United States Patent [19]

Escalette

[11] 3,978,799

[45] Sept. 7, 1976

[54] DISPLAY HARDWARE FOR LOCK SETS

[75] Inventor: Henry Ross Escalette, Santa Ana, Calif.

[73] Assignee: TRE Corporation, Beverly Hills, Calif.

[22] Filed: Feb. 13, 1975

[21] Appl. No.: 549,536

[52] U.S. Cl. ..... 108/28; 248/DIG. 3; 211/181; 211/88

[51] Int. Cl.[2] ..... A47G 29/00

[58] Field of Search ..... 248/DIG. 3; 211/106, 211/131, 54, 57, 59, 88, 90; 70/431; 206/321

[56] References Cited

UNITED STATES PATENTS

| | | | |
|---|---|---|---|
| 1,569,679 | 1/1926 | Sanborn | 206/321 |
| 1,888,649 | 11/1932 | Anderson | 108/28 X |
| 1,890,181 | 12/1932 | Hoffman | 206/321 X |
| 2,315,595 | 4/1943 | Chappory | 211/181 |
| 2,746,609 | 5/1956 | Welsh | 211/106 X |
| 3,101,148 | 8/1963 | Brown | 211/181 X |
| 3,345,026 | 10/1967 | Schlage | 211/13 X |
| 3,481,481 | 12/1969 | Witek et al. | 248/DIG. 3 X |
| 3,774,320 | 11/1973 | Folberth, Jr. | 248/DIG. 3 X |

*Primary Examiner*—Roy D. Frazier
*Assistant Examiner*—Peter A. Aschenbrenner
*Attorney, Agent, or Firm*—Blakely, Sokoloff, Taylor & Zafman

[57] ABSTRACT

Display hardware for lock sets which is adapted to display a variety of lock sets enabling a viewer to visually and manually demonstrate the various features and components of each lock set is disclosed. The hardware comprises a lock assembly fixedly secured in a mounting block with generally flat sides and apertures receiving the lock assembly, the lock assembly being disposed through the apertures in flat sides of the block to display the lock assembly in a mounted condition. The block for displaying the lock assembly is coupled to and extends outwardly from a suitable shelf. The shelf has at least one generally elongated horizontal member which is arranged and configured so as to be adapted to receive, store and display packaged lock sets corresponding to the lock sets displayed on the mounting block coupled to the shelf. The display hardware enables one to quickly and easily determine the particular lock set on the shelf, and to demonstrate the specific features associated with that lock set and the manner in which the lock set operates.

5 Claims, 6 Drawing Figures

DISPLAY HARDWARE FOR LOCK SETS

BACKGROUND OF THE INVENTION

1. Field of the Invention

This invention relates to the field of display hardware and apparatus, and more particularly, to display hardware used for demonstrating and identifying the various components, features and method of operation of different lock sets and similar products or devices.

2. Prior Art

There is a multitude of ways in which to merchandise door locking mechanisms. And because theft and robbery have become such an acute problem in today's society, the number of different locks, and the number of ways in which these locks are displayed have met with great proliferation. It should be noted from the onset, that the various means of presenting a product, such as, for example, a door locking mechanism has progressed to that being almost a science. For example, the specific display used to demonstrate the features of the various door locking mechanisms, e.g., knobs, entry handles, dead bolts, etc., may or may not adequately inform the purchaser of the various features associated with such a locking means. If these features are adequately demonstrated, the purchaser is then able to make an informed decision as to which of several different locking means to purchase. For example, should a dead bolt type lock be desired, the purchaser may want to examine several locks with the various features associated with that of a dead bolt before making a decision. Factors, such as ease of installation or operation, appearance, etc., may become the determining factor in which a purchaser may choose one lock over another. Thus, the manner in which lock sets are displayed and can be operated, provide an important function to consumers and prevent subsequent customer dissatisfaction. Lock sets are typically displayed in a store in a manner which does not afford the customer an adequate opportunity to inspect the lock set. One typical display hardware for lock sets is to place a number of the individually packaged lock sets in various bins on a shelf, for example, in a hardware store. The problem associated with this method are several; first, there is a tendency, after a number of people have passed through the store, for locks in one bin to become intermingled with the locks in another bin. Thus, one looking at one lock set package in one bin would not know whether the other locks in that same bin were substantially similar or completely different. Second, because some purchasers may open up the packaged lock sets to see the various components inside, and to operate the lock, there is a tendency for some of the components of each lock set to fall out of the package and become lost. This can cause problems in selling the locks and result in substantial loss of revenue to the seller. Finally, the purchaser, upon looking at a packaged lock set in one bin, would not know the specific features associated with the lock sets, and would not know exactly how the lock set would operate once installed. Thus, in the "bin" method of displaying lock sets, consumers are deprived of comparison shopping unless they actually break open the packages containing the lock sets.

In another prior art display hardware for lock sets, the various different lock sets, knobs, key locks, etc., are hung from a support member which is disposed in a "peg board" mounting wall. Generally, only two or three lock sets can be disposed on each member, and six to ten members are disposed across and down the peg board. Positioned above or along the various support members is a separate display where the lock sets have been assembled and the various lock assemblies may be viewed by the purchaser. The problem with this display is that it is difficult to determine which of the assembled lock sets correspond to the various lock sets hanging from the various support members on the peg board. For example, often a series of lock assemblies are disposed at one location. While some of the features of each lock may be adequately demonstrated, the difficulty arises when the purchaser has chosen a specific lock. The specific lock set package must now be located among all the packages on the shelf or mounting wall, and often times, many of the packages for different types of locks look substantially the same. Hence under the peg board system there is a great chance the wrong lock package will be selected. Moreover, many times these types of displays do not adequately demonstrate all of the features associated with each lock, and thus, the problem of a purchaser opening the lock packages in order to better determine the features and components associated with each lock is not completely prevented.

In the present invention, problems associated with prior art display hardware is overcome by providing a lock assembly secured to a vertical member of a shelf such that all the features of the lock assembly may be quickly, easily, and accurately examined and seen without the need for opening any of the packaged lock sets. In addition, more packaged lock sets may be displayed on the same wall as compared to lock sets mounted on hanging support members. Moreover, because of the configuration between the shelf and the display means, the lock assembly which is demonstrated can quickly and readily be found in a corresponding package on the shelf. Thus, the present invention provides a simple yet effective means to display various features associated with locks and organize them in such a way as to prevent loss and incorrect purchases and to increase sales.

While the preferred embodiment deals with certain display hardware for lock sets, it is apparent that it is also applicable and useful for other products such as tools normally sold in the same fashion.

SUMMARY OF THE INVENTION

The present invention relates to display hardware for lock sets and similar products or devices (e.g., tools) wherein the display hardware aids in the visual ad manual demonstration of the various features and components associated with different lock sets. The display hardware is arranged and configured such that it may be secured to a wall, such as, for example, a peg board, i.e., a mounting wall in which a number of holes are disposed therethrough enabling hooks and the like to be secured to it. In the preferred embodiment, the display hardware comprises a lock assembly fixedly secured in means for displaying the lock assembly. The means for displaying the lock assembly and the lock assembly are arranged and configured as to permit a purchaser to completely demonstrate for himself the locking and unlocking action and other features of each lock assembly to be sold. The means for displaying the lock is most often a block having at least two relatively large flat sides and an opening passing through such sides with the lock assembly axially disposed through the opening.

The display hardware also includes a shelf having at least one generally horizontal member capable of receiving and displaying the packaged lock sets. The block for displaying the lock assemblies is coupled to and extends outwardly from the shelf so that the lock assembly can be operated without interference with the shelf. The block and the shelf may also be color coded in such a way as to quickly and accurately point out that the packaged lock sets positioned on the shelf are the same locks as the ones which are assembled.

By examination and operation of the lock assembly disposed through the block, one can quickly and readily determine the appearance and all of the features 10 associated with that lock as well as the general components and method of assembly. Being able to quickly and accurately determine all of the features associated with the specific locks is thus one object of the present invention.

Another object of the present invention is to provide display hardware for lock sets and other similar products (e.g., tools) which is simple to assemble, inexpensive, and easy to use.

Another object of the present invention is to provide a system for quickly and accurately selecting a lock based on an intimate knowledge of features associated with that lock.

Yet another object of the present invention is to enable a purchaser to accurately and correctly select the lock sets having the appearance and features which are desired.

Yet another object of the present invention is to provide display hardware which prevents mistakes in the purchasing of lock sets, and which enables the lock assembly to be completely viewed without the necessity of opening up the packages containing the various lock sets.

The novel features which are believed to be characteristic of the invention, both as to its organization and method of operation, together with further objectives and advantages thereof, will be better understood from the following description considered in connection with accompanying drawings in which a presently preferred embodiment of the invention is illustrated by way of example. It is to be expressly understood, however, that the drawings are for the purpose of illustration and description and not intended as a definition of the limits of the invention.

DETAILED DESCRIPTION OF THE INVENTION

Figure 1:
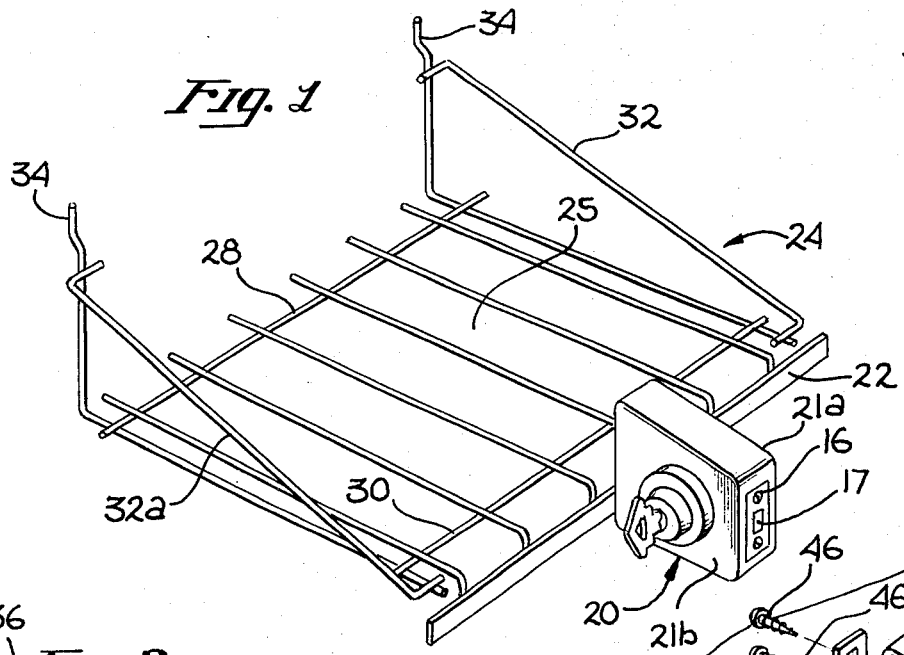
FIG. 1 is a perspective view of the first embodiment of the present invention showing a typical lock assembly and the means for displaying the lock assembly coupled to a rack type shelf.

Referring first to FIG. 1, there is shown, as the presently preferred embodiment, the first embodiment of the present invention. Lock assembly 10 is disposed through a suitable opening in a portion of the mounting means 20. The lock assembly 10 and the mounting means 20 are arranged and configured such that a complete demonstration of the locking and unlocking action of the lock assembly may be viewed, for example, by a purchaser. The mounting means 20 for displaying the lock assembly is shown as vertically coupled to, and extending outwardly from the shelf 24. The shelf 24 may be of a general rack type construction such as is known in the art having at least one horizontal member 25 capable of receiving and displaying the packaged lock sets to be stored thereon.

In the first embodiment of the present invention the means for displaying the lock includes an angular shaped block 21. The shape and size of the block 21 can vary depending on the nature of the lock and the desired appearance of the block. A typical lock assembly 10 is shown as circumferentially disposed in the block 21. The lock assembly 10 includes an associated key 12, a handle actuator 18 and outside rosettes 41 and 14'. The outside rosettes 14 and 14' are generally mounted on the door to cover the opening in the door for receiving the lock mechanism. On one side of the block 21 is the handle 18 and on the other side is the key actuated mechanism and key 12. By rotation of the key 12 and/or the handle 18, the latch bolt 17 located in the latch plate 16 extends and retracts. Thus, when the purchaser desires to see the specific action of a specific lock assembly, for example, typical lock assembly 10, he need only rotate handle 18 and/or the associated key 12 to see the type of action and movement of the latch bolt 17 and other features. This provides the customer with a working knowledge of the operation and various features associated with this specific lock assembly. Further, the appearance, general relationship of the various components, their mode of construction, and their method of assembly, is more apparent than when viewed in a package. Of course, other types and kinds of lock assemblies, handle means, and latch bolts may be disposed in the mounting means 20 and are within the scope of the invention.

Referring again to FIG. 1, the angular block 21 is shown as having two flat sides 21*a* and 21*b* respectively with the lock assembly 10 disposed through an opening in these flat sides and mounted in the same fashion as the lock would be on a door in actual use. In the presently preferred embodiment, the flat sides 21*a* and 21*b* have a generally trapezoidal shape, with one of the parallel edges of the trapezoid being the edge along which the block 21 is coupled to the shelf 24 and the other parallel edge contains the latch plate 16. The trapezoidal shape provides a desirable configuration for the imprinting various reference and model numerals and other customer information on the surface T of the block which can be seen by the customer. The block 21 is coupled to the shelf 24 such that it extends outwardly from the shelf and is mounted so as to be in a generally vertical position with respect to the horizontal member 25.

Any conventional means for coupling the block 21 to the shelf 24 may be utilized. For example, screws, rivets, bolts, glue are all within the scope of the present invention. In the presently preferred embodiment, however, the block 21 is coupled to a vertical mounting strip 22 of a generally rectangular shape. The vertical mounting strip 22 is disposed to the front of the horizontal member 25 of the shelf 24. In the presently preferred embodiment, the rack type shelf 24 is constructed of a plurality of metal strut sections 26 generally shown in FIG. 1. By way of example, the shelf can be about 15½ inches wide, 14 inches deep and from 4 to 8 inches high. The size of the shelf is dependent on the size and quantity of the lock packages to be stored thereon. The strut sections 26 are joined together in a conventional manner towards the back of the shelf 24 by means of back support member 28 and toward the front of the shelf 24 by means of front support member 30. The sides of the shelf are defined by shaped metal strut sections 32 and 32*a* respectively. In the presently preferred embodiment, this rack type shelf 24 is adapted so as to be readily portable, basically complete, and may be selectively coupled to what is generally referred to in the art as a "peg board." Peg boards usually come in sheets and are usually attached to a mounting wall. The peg board has a plurality of holes disposed therethrough which allow various curved metal members to become selectively disposed in the holes such that the members may be easily coupled and uncoupled from the board.

Figure 2:
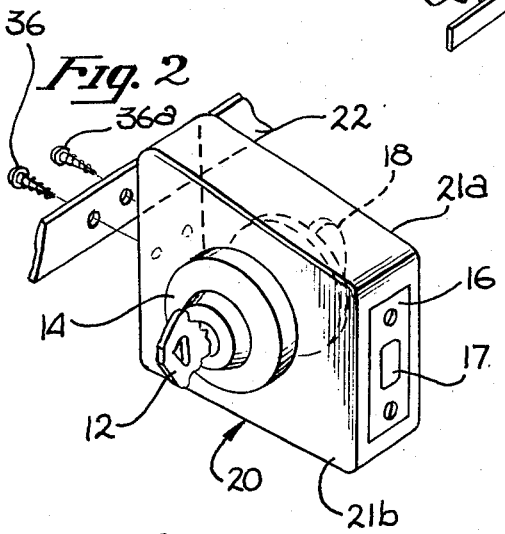
FIG. 2 is an exploded perspective view of the lock assembly and means for displaying the lock assembly of FIG. 1, and the associated attaching means for coupling the lock assembly to the shelf.

Now referring to FIG. 2, the block 21 and the mounting means 20 are shown as coupled together by means of screws 36 and 36*a*. Screws 36 and 36*a* represent the presently preferred embodiment of coupling the block 21 to the shelf 24, but other means described above are within the scope of the invention.

Figure 3:
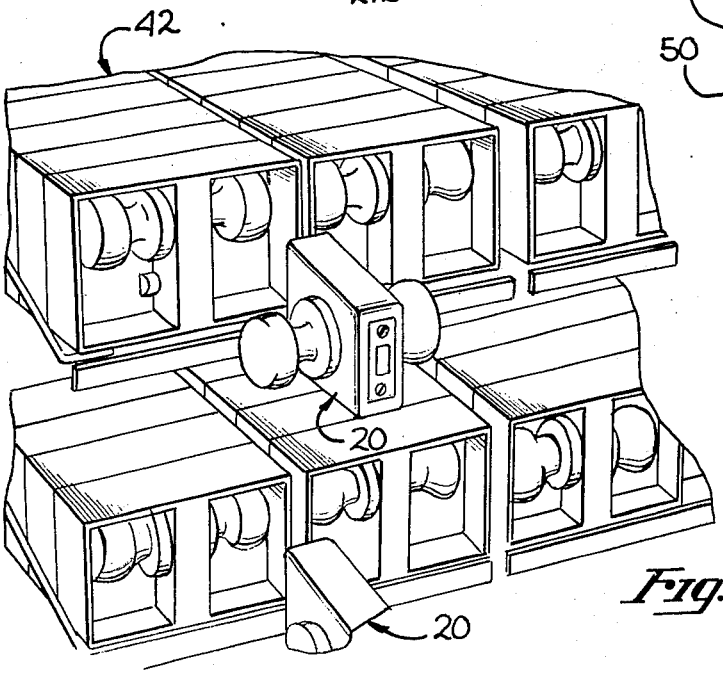
FIG. 3 is a perspective view of a plurality of packages containing lock assemblies disposed on the shelves corresponding to the lock set displayed thereon.

Referring now to FIG. 3, a number of the hereinbefore described shelves and associated mounting for the lock assemblies means have been disposed on a peg board 42 as is typically done in a hardware store and the like to form display 40. Packages of the lock sets, represented generally by numeral 43, have been arranged in the various shelves so as to correspond to the specific lock assemblies disposed in the mounting means. As can be readily seen in this figure, a purchaser, upon passing the display, can readily, accurately, and conveniently determine all of the necessary features of a specific lock assembly and easily and accurately select the corresponding lock from the specific shelf.

In another embodiment of the present invention, the vertical mounting strip 22 and the means for displaying the lock assembly 20 are color coded (i.e., the same color) enabling even easier selections of the specific lock desired and preventing most mistakes associated with selecting locks from a display. By the term "color coding" it is meant that the mounting means 20 and the vertical mounting strip 22 are colored in such a manner as to indicate the specific lock located generally behind the lock assembly disposed in the mounting means 20. The specific color coding also includes the use of various printed material which enables the purchaser to readily distinguish among associated locks. For example, on the top row of a typical display, all of the locks having a "dead bolt" may be disposed. The word "dead bolt" would appear on each of the mounting means 20 and on the vertical mounting strip 22. But to distinguish among all the dead bolts, for each different dead bolt, a different color would be used; the color used on the mounting means 20 and the vertical mounting strip 22 would correspond to a color on that specific box, containing the specific lock assembly disposed in the mounting means 20 FIGS. 1 and 3 also show that the block 21 is generally disposed in the middle of the front of each separate shelf 24. This also helps prevent mistaken purchases as the shelf and the corresponding lock set are easily associated. In addition because the shelf 24 is readily portable and basically complete, the shelf 24 or a series of shelves may be disposed and/or where desired with relative ease.

Figure 4A:
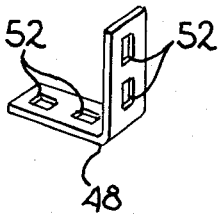
FIG. 4*a* is an exploded perspective view of the bracket shown in FIG. 4.
Figure 4:
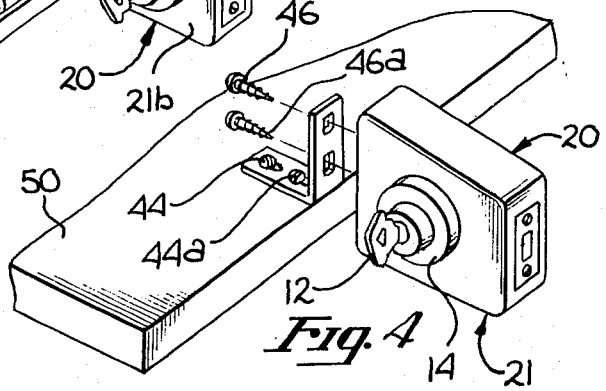
FIG. 4 is a perspective view of the second embodiment of the present invention showing the means for displaying the lock assembly coupled to a rigid shelf by an associated bracket.

Referring now to FIG. 4, a second embodiment of the present invention is shown. In this embodiment, the horizontal support member or shelf 50 is a generally solid member extending outwardly from a mounting wall, with a plurality of mounting holes 51 disposed therethrough. The mounting means 20 is coupled to the horizontal member 50 by means of an angular bracket 48 and screws 44 and 44*a* , 46 and 46*a* respectively. In FIG. 4*a* an enlarged view of the angular bracket 48 is demonstrated. The angular bracket 48 is adjustable on the horizontal member 50 and on the mounting means 20 because of slots 52 located on the horizontal section of the bracket and slots 54 located on the vertical section of bracket. These slots enable some movement for adjustment of the bracket with respect to the horizontal member 50 as well as some movement for adjustment of mounting means 20 with respect to the horizontal member 50. Moreover, the bracket 48 enables the mounting means 20 to be easily coupled to shelves which already have a plurality of holes disposed on the horizontal member as is often the case on commercially available display shelves.

In the second embodiment of the present invention, horizontal member 50, with a plurality of holes H therethrough, is utilized. These holes H are spaced apart at various distances on the shelf to provide a plurality of mounting positions. By providing slots 52 on the bracket 48, the bracket may be coupled to the horizontal member in various positions. Thus, the mounting means 20 may be positioned where desired on the horizontal member 50 so as to insure a secure and conveniently located mounting.

It should be noted that in the first embodiment the shelf 24 is free standing, and forms a readily portable unit which is easy to relocate and is comprised of the shelf 24 and the means 20 for mounting and displaying the lock unit 10. In the second embodiment, such overall portability of the display shelf is not present. However, by means of the angular bracket 48, any present shelf may be readily adapted to the mounting means 20 without the need of any type of specific mounting wall or hooks. Also, the mounting means 20 can be moved from one shelf to another, if desired.

Figure 5:
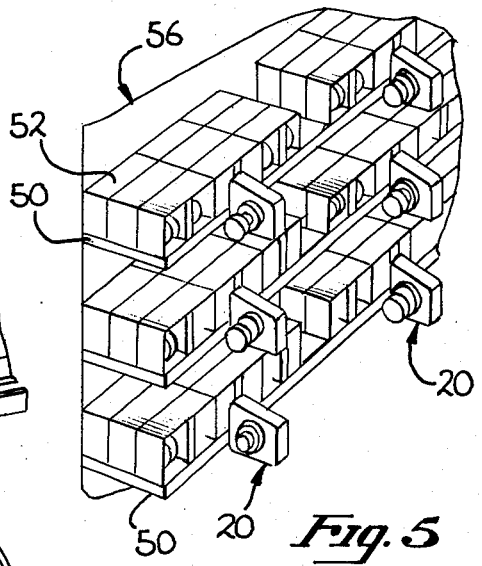
FIG. 5 is a perspective view of a plurality of shelves of the second embodiment of FIG. 4 of the present invention showing the shelves with a lock set mounted on the display means and the corresponding lock sets in packages disposed on the shelves.

In FIG. 5, packages of the packaged lock sets, generally represented by the numeral 52, are shown on the horizontal shelf means 50. By placing the packaged lock set 62 behind the corresponding assembly 10 and mounting means 20, consumers are able to quickly see the features of each lock assembly shown in the display 56 and to select the proper packaged lock set.

There has been described herein a new and novel display hardware for lock sets which provides for relative ease in displaying a number of different lock sets, and which enables the purchaser to accurately and easily determine the appearance and other features associated with the various lock sets and to aid in the selection of the correct lock set without opening packages. Although this invention has been disclosed and described with reference to particular embodiments, the principles are susceptible of other applications which will be apparent to persons skilled in the art. This invention, therefore, is not intended to be limited to the particular embodiments herein disclosed.

I claim:

1. Display apparatus for packaged lock sets which provides for visual inspection and manual demonstration of each type of lock set comprising:

a shelf of welded wire construction, said shelf having a plurality of wire members in a horizontal plane defining a shelf surface for supporting a plurality of packaged lock sets thereon, said shelf further having side wire members angularly offset from the plane of said shelf surface, said side wire members extending from the front to the back of said shelf to provide structural support thereto and said shelf having a vertically disposed member at the front edge thereof, said verticaly disposed member being disposed below said shelf surface, means adjacent the back of said shelf for coupling said shelf to a pegboard;

a block for receiving a lock, said block having substantially parallel first and second sides adjoining a substantially vertically disposed front face simulating a portion of a typical door on which the lock might be used, said block being ported and relieved to receive a lock to be displayed with the latch bolt of the lock disposed outward through said front face; and means for coupling the back portion of said block to the front of said vertically disposed shelf member whereby said block is supported forward of said shelf surface and may display an individual lock of the type stored in packaged form on said shelf and whereby said packaged locks may be slid directly forward for removal from said shelf surface.

2. The display apparatus of claim 1 wherein said side wire members extend from the front of said shelf at substantially the same elevation as said shelf surface to a position at the back of said shelf substantially above said shelf surface, thereby defining sides of said shelf to define the storage limits for the type of locks displayed in said block.

3. The display of apparatus of claim 1 wherein at least a portion of said block is colored in unison with the coloring of at least a portion of the packages containing locks of the type to be displayed in said block.

4. Display apparatus for packaged lock sets which provides for visual inspection and manual demonstration of each type of lock set comprising:

a shelf of welded wire construction, said shelf having a plurality of wire members in a horizontal plane defining a shelf surface for supporting a plurality of packaged lock sets thereon said shelf also having a vertically disposed member at the front edge thereof, said vertically disposed member being disposed below said shelf surface;

means adjacent the back of said shelf for coupling said shelf to a pegboard, said last named means being formed by extensions of some of said wire members to project through a pegboard;

a block for receiving a lock, said block having substantially parallel first and second sides adjoining a substantially vertically disposed front face simulating a portion of a typical door on which the lock might be used, said block being ported and relieved to receive a lock to be displayed with the latch bolt of the lock disposed outward through said front face; and means for coupling the back portion of said block to the front of said vertically disposed shelf member whereby said block is supported forward of said shelf surface and may display an individual lock of the type stored in packaged form on said shelf and whereby said packaged locks may be slid forward for removal from said shelf surface.

5. The display of apparatus of claim 4 wherein at least a portion of said block is colored in unison with the coloring of at least a portion of the packages containing locks of the type to be displayed in said block.

* * * * *